US006565383B1

(12) United States Patent
Wu

(10) Patent No.: US 6,565,383 B1
(45) Date of Patent: May 20, 2003

(54) ELECTRICAL CONNECTOR WITH LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/242,099

(22) Filed: Sep. 11, 2002

(51) Int. Cl.[7] ..... H01R 13/60
(52) U.S. Cl. ..... 439/567; 439/358
(58) Field of Search ..... 439/567, 357, 439/358, 293, 295

(56) References Cited

U.S. PATENT DOCUMENTS

| | | | | |
|---|---|---|---|---|
| 4,681,389 A | | 7/1987 | Nakazawa et al. | |
| 4,946,404 A | * | 8/1990 | Takenouchi et al. | 439/352 |
| 5,445,534 A | | 8/1995 | Ishizuka et al. | |
| 5,775,931 A | | 7/1998 | Jons | |
| 5,820,393 A | | 10/1998 | Edgley et al. | |
| 5,876,232 A | * | 3/1999 | Matsushita et al. | 439/357 |
| 5,924,886 A | | 7/1999 | Achammer et al. | |
| 5,938,470 A | * | 8/1999 | Kashiyama | 439/489 |
| 6,123,580 A | | 9/2000 | Bendorf et al. | |
| 6,203,353 B1 | * | 3/2001 | Huang et al. | 439/352 |

* cited by examiner

*Primary Examiner*—Lynn D. Feild
*Assistant Examiner*—Phuong Dinh
(74) *Attorney, Agent, or Firm*—Wei Te Chung

(57) ABSTRACT

An electrical connector (10) includes a housing (12), a plurality of contacts (14) mounted in the housing and a locking member (16). The housing has a base (18) and a pair of mounting portions (32) extending rearwardly from opposite ends of the base and each defining a lock receiving passage (34). The locking member is attached to the housing and comprise a center beam (42) abutting against the base, a pair of lock portions (46) bent downwardly from opposite ends of the beam and retained in the lock receiving passages, and a pair of side arms (54) extending forwardly from the center beam. Each side arm has a hook (58) at a front end thereof for being retained in a corresponding receiving hole (66) of a complementary connector (60) when mated.

11 Claims, 9 Drawing Sheets

ELECTRICAL CONNECTOR WITH LOCKING MEMBER

CROSS-REFERENCE TO RELATED APPLICATION

This patent application is a co-pending application of the U.S. patent application with an known serial number filed on the same day and by the same inventor, entitled "CABLE END CONNECTOR WITH LOCKING MEMBER" and assigned to the same assignee of this patent application.

BACKGROUND OF THE INVENTION

1. Field of the Invention

The present invention relates to an electrical connector with a locking member for both locking with a complementary connector and securing to a printed circuit board.

2. Description of Related Art

Complementary electrical connectors typically include dielectric housings respectively receiving a plurality of terminals or contacts which, when the connectors are mated, establish an electrical interconnection therebetween. The complementary connectors may be male and female connectors or plug and socket connectors for electrically connecting the terminals or contacts received therein. In some instances, the connectors have complementary latches for locking the connectors together when mated. U.S. Pat. Nos. 5,445,534, 5,775,931, and 5,924,886 disclose different forms of latch structures to provide reliable mechanical connection therebetween.

On the other hand, the connector assembly is generally assembled to a substrate, such as a printed circuit board. Thus, one connector of the connector assembly is desirable to have a locking structure for securing the connector to a printed circuit board. It is common to incorporate into the electrical connector assembly a board-lock in order to anchor the connector assembly to the printed circuit board. Such locking structures are disclosed in U.S. Pat. Nos. 4,681,389, 5,820,393 and 6,123,580.

As stated above, the present problem people in the art confronts, is that an electrical connector may be required to have a latch structure for locking with a complementary connector and a locking structure for securing the connector to a printed circuit board. Under this situation, it is not convenient to directly add the latch structure and the lock structure, which makes the manufacturing of the connector complicated. There exists in the art an electrical connector known as a Serial Advanced Technology Attachment (Serial ATA) connector which is generally used for disk drives and storage peripherals. Especially, the Serial ATA connectors according the Serial ATA standard are featured in fewer electrical contacts than other conventional electrical connectors and are relatively tiny in configurations, and it is more desirable for the Serial ATA connector to have a locking member for both positioning the connector on a printed circuit board and providing a reliable mechanical connection with a complementary connector.

Hence, an electrical connector with a locking member for both locking the connector with a complementary connector and securing the connector to a printed circuit board is required to overcome the disadvantages of the related art.

SUMMARY OF THE INVENTION

An object, therefore, of the present invention is to provide an electrical connector with a locking member for both locking the connector with a complementary connector and securing the connector to a printed circuit board.

Another object of the present invention is to provide an electrical connector with a locking member adapted to easily lock/release with/from a complementary connector.

In order to achieve the objects set forth, an electrical connector in accordance with the present invention includes a housing, a plurality of contacts mounted in the housing and a locking member. The housing has a base and a pair of mounting portions extending rearwardly from opposite ends of the base and each defining a lock receiving passage. The locking member is assembled to the housing and comprises a center beam abutting against a rib formed on the base, a pair of lock portions bent downwardly from opposite ends of the center beam and retained in the lock receiving passages, and a pair of side arms extending forwardly from the center beam. Each side arm has a hook at a front end thereof for being retained in a corresponding receiving hole of a complementary connector when mated. The lock portions extend out of the lock receiving passages for being inserted in appropriate holes of a printed circuit board where the connector is mounted.

Other objects, advantages and novel features of the invention will become more apparent from the following detailed description when taken in conjunction with the accompanying drawings.

DETAILED DESCRIPTION OF THE INVENTION

An electrical connector generally comprises a locking member for locking the electrical connector with other electrical components, such as a complementary connector or a printed circuit board. FIGS. 1–10 of the attached drawings show a locking member constructed in accordance with the present invention. Such a locking member is in general adapted in an electrical connector mounted on a printed circuit board for mating with a complementary connector. The following description of the locking member of the present invention is illustrative only, not to restrict the use and application of the locking member.

Figure 1:
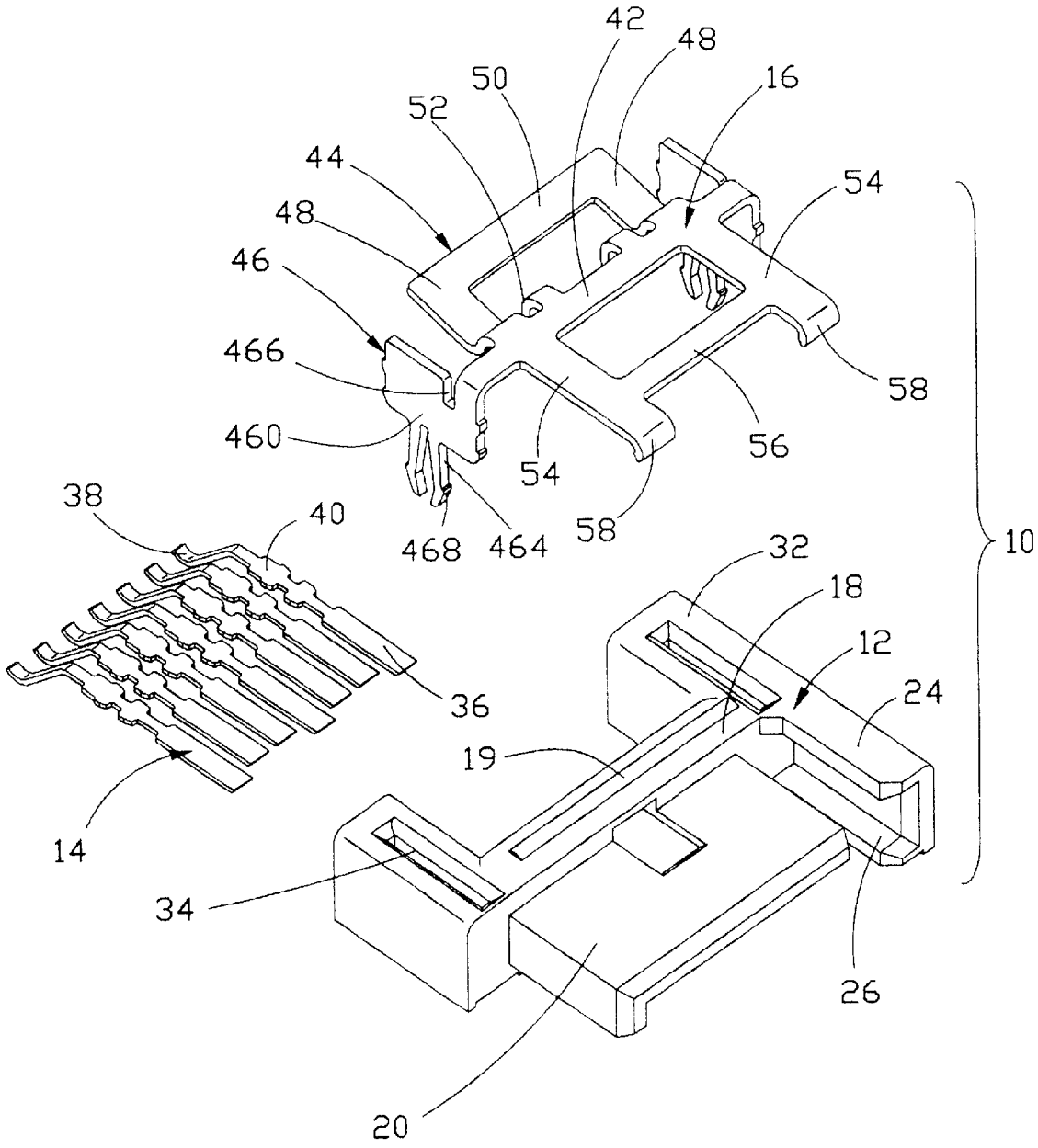
FIG. 1 is an exploded, perspective view of an electrical connector with a locking member in accordance with the present invention.

Referring to FIG. 1, an electrical connector in accordance with the present invention, generally designated 10, is adapted for mating and locking with a complementary connector designated 60 (FIG. 8) and for mounting on a substrate, such as a printed circuit board 200 (FIG. 10), that would typically have circuit traces disposed thereupon. In the embodiment shown, the electrical connectors 10 and 60 are typical standard Serial ATA connectors. However, in alternative embodiments, the electrical connectors could be provided as other than Serial ATA electrical connectors.

Figure 2:
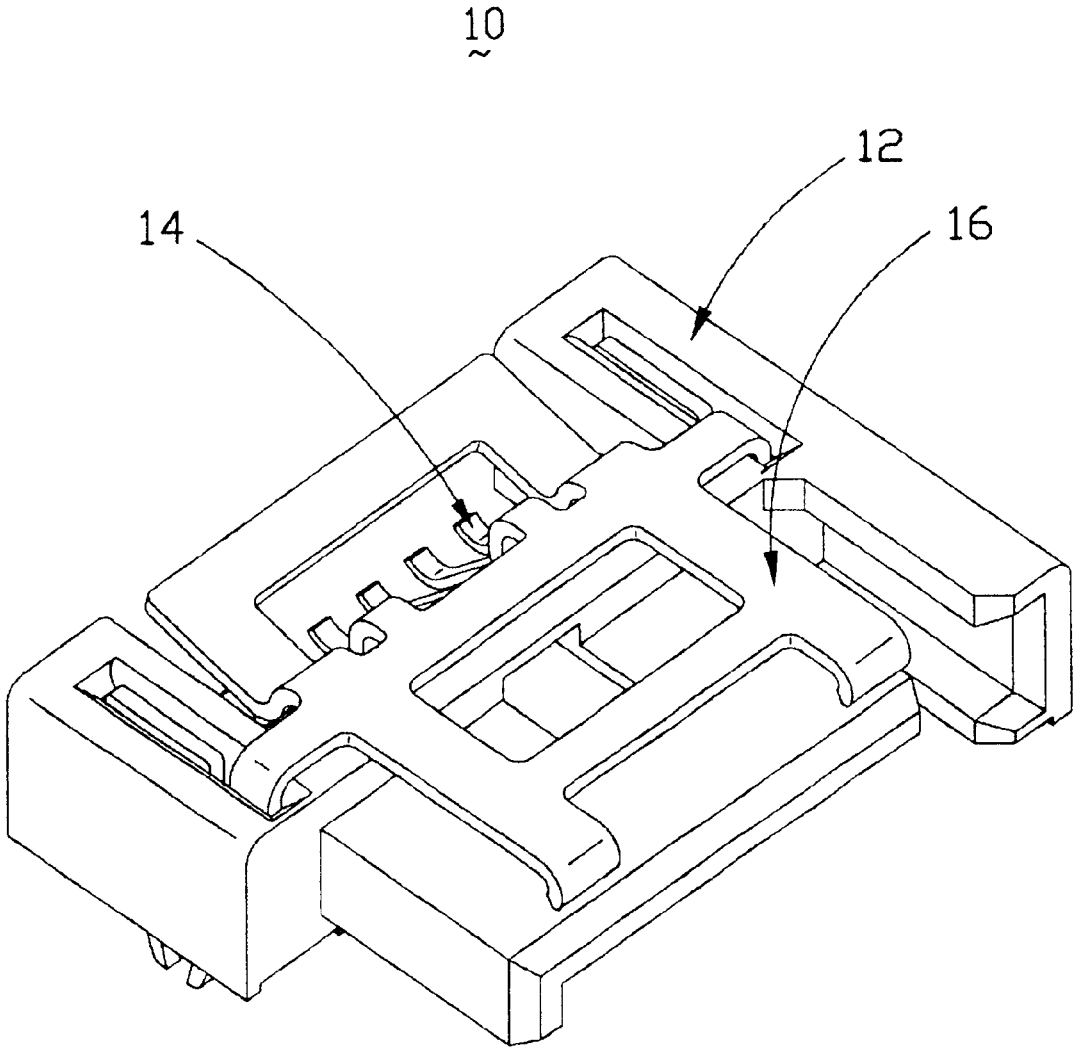
FIG. 2 is an assembled perspective view of the electrical connector of FIG. 1.
Figure 3:
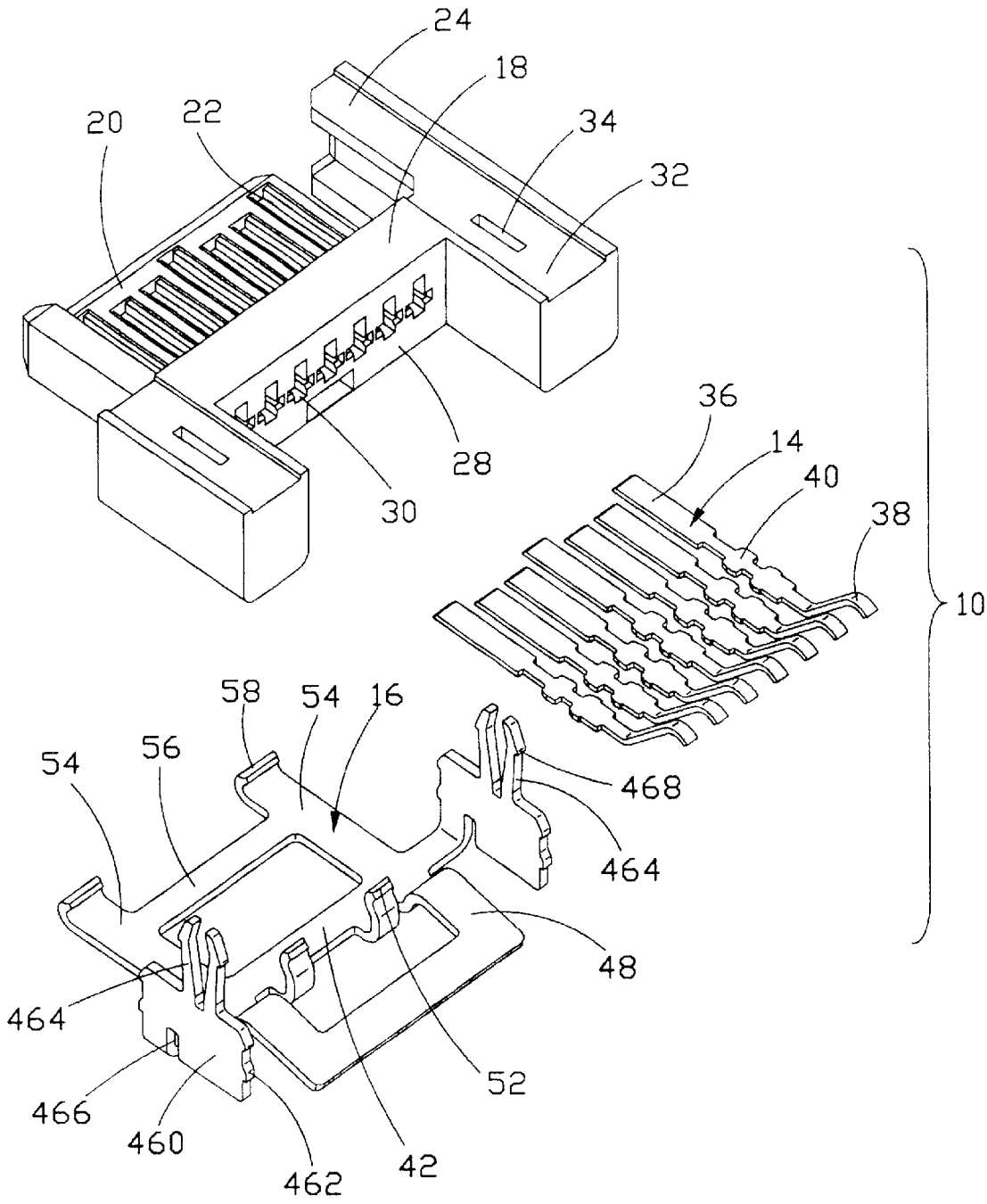
FIG. 3 is a view similar to FIG. 1, but taken from rear and bottom aspects.
Figure 4:
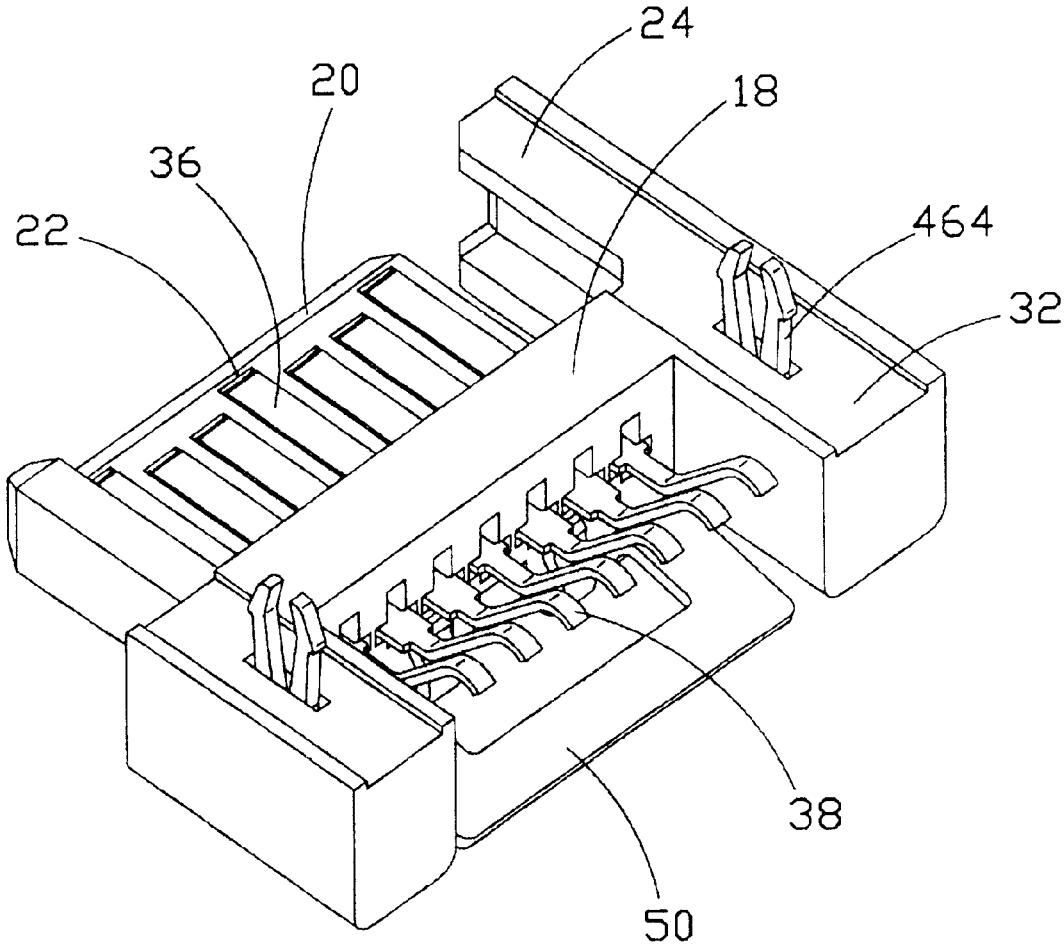
FIG. 4 is an assembled perspective view of FIG. 3.
Figure 5:
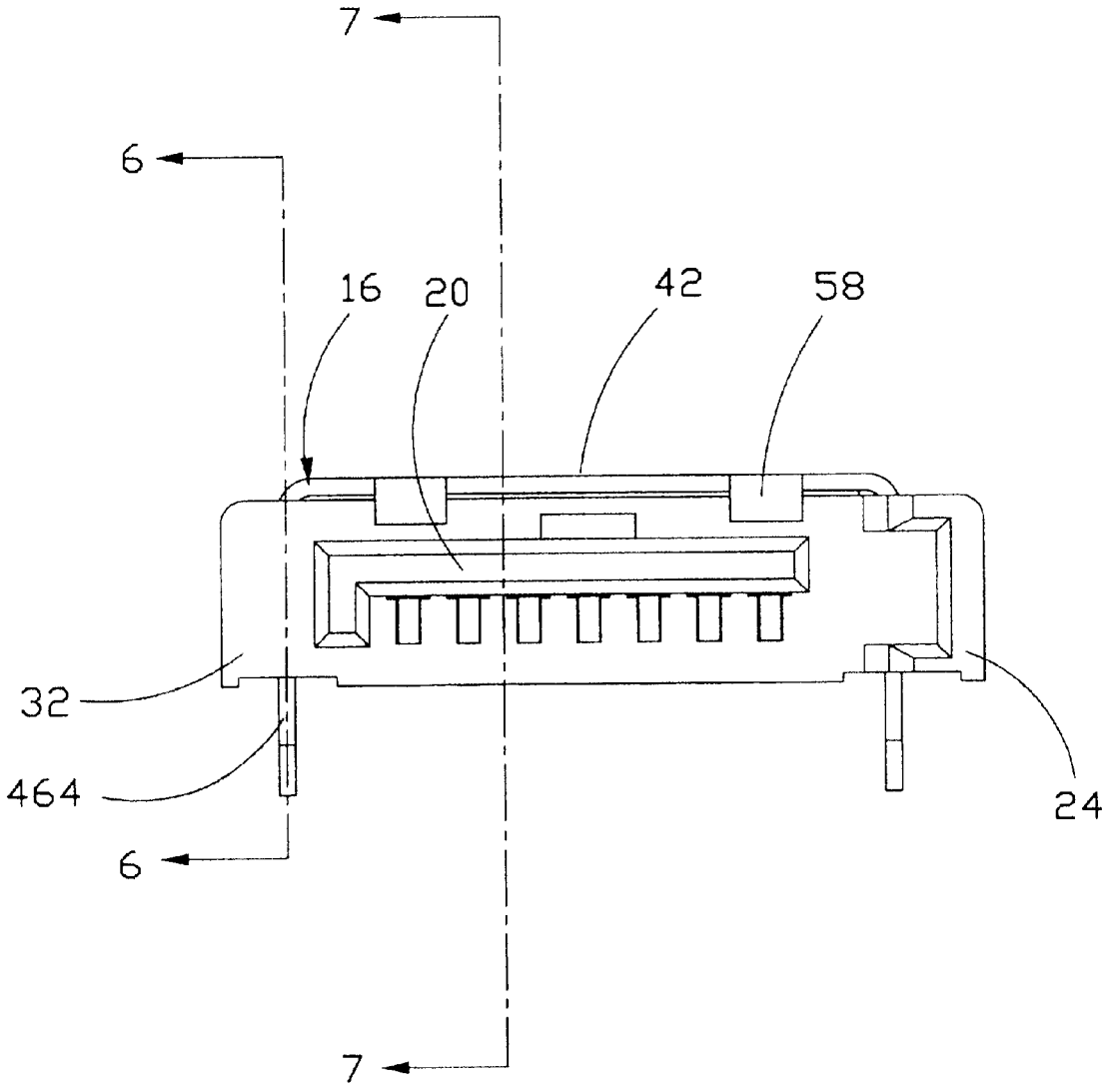
FIG. 5 is a front plan view of the electrical connector of FIG. 2.

Referring also to FIGS. 2–3, the electrical connector 10 generally comprises an insulative housing 12, a plurality of electrical contacts 14 and a locking member 16. The housing 12 has an elongate base 18. A rib 19 projects upwardly from an upper surface of the elongate base 18. A mating tongue 20 extends forwardly from the base 18 and defines a plurality of positioning slits 22 with different longitudinal dimensions. The mating tongue 20 is L-shaped and is adapted for being inserted in a corresponding receptacle 64 (FIG. 10) of the complementary connector 60 (FIG. 8) to provide polarization, and for locating the electrical connector 10 at a relatively precise position relative to the complementary connector 60. A lateral end portion 24 extends forwardly and parallel to the mating tongue 20 and defines a rectangular recess 26 facing the mating tongue 20.

The base 18 of the housing 12 has a rear surface 28 opposite to the mating tongue 20. A plurality of passageways 30 extends through the base 28 and respectively communicates with corresponding positioning slits 22. A pair of mounting portions 32 projects rearwardly from respective ends of the base 18 and each defines a lock receiving passage 34 for purposes described hereinafter.

Each electrical contact 14 is stamped and formed from a flat metal sheet into the shape as shown. As best shown in FIG. 3, each contact 14 has a contact portion 36 at one end thereof received in a corresponding positioning slit 22 of the mating tongue 20, a tail portion 38 at the other end thereof adapted for surface connection, such as by soldering, to a corresponding circuit trace on the printed circuit board, and a retention portion 40 connecting the contact portion 36 and the tail portion 38. The electrical contacts 14 are assembled in the housing 12 from the rear surface 28 of the base 18 with the retention portions 40 retained in corresponding passageways 30. It should be noted that the retention portions 40 of the contacts 14 have different longitudinal dimensions, that makes the length of the contact portions 36 extending away from the base 18 different. The contact portions 36 are snugly retained in corresponding positioning slits 22 with different longitudinal dimensions to provide first mating and last breaking functions which are known to persons skilled in the art and the detailed description thereof is thus omitted here.

The locking member 16, generally fabricated from a piece member made of metal or other resilient materials by stamping or in other ways, comprises a center beam 42, a resilient portion 44 extending rearwardly from the center beam 42, and a pair of lock portions 46 bent downwardly from opposite ends of the center beam 42. The resilient portion 44 comprises a pair of arms 48 connecting with the center beam 42 and a pushing portion 50 connecting the pair of arms 48. Two retaining tabs 52 extend rearwardly from the center beam 42 and then bend downwardly for engaging with the rear surface 28 of the housing 12. The locking member 16 further comprises a pair of opposite side arms 54 extending forwardly from the center beam 42. The pair of side arms 54 is connected by a transitional portion 56 opposite to the center beam 42. Each side arm 54 has a hook 58 bent downwardly therefrom.

Each lock portion 46 of the locking member 16, as shown in FIGS. 1 and 3, comprises a rectangular body 460 having engaging portions 462 formed on opposite lateral edges of the body 460 and a pair of legs 464 extending from a low edge thereof. The body 460 defines a slot 466 adjacent to the conjunction of the lock portion 46 and the center beam 42. The pair of legs 464 is spaced from each other and each has a retaining portion 468 at a lower end thereof.

Figure 6:
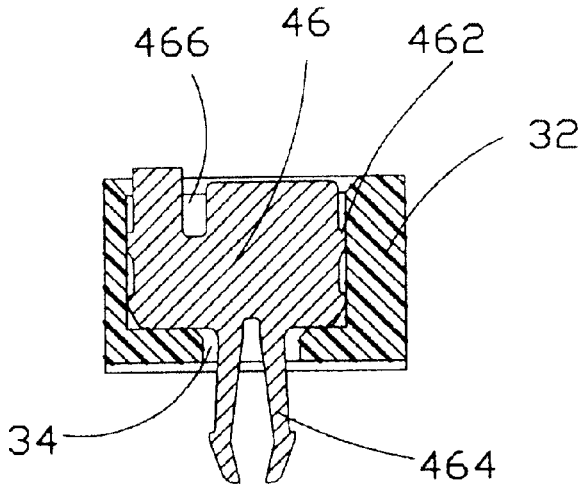
FIG. 6 is a cross-sectional view taken along line 6—6 of FIG. 5.
Figure 7:
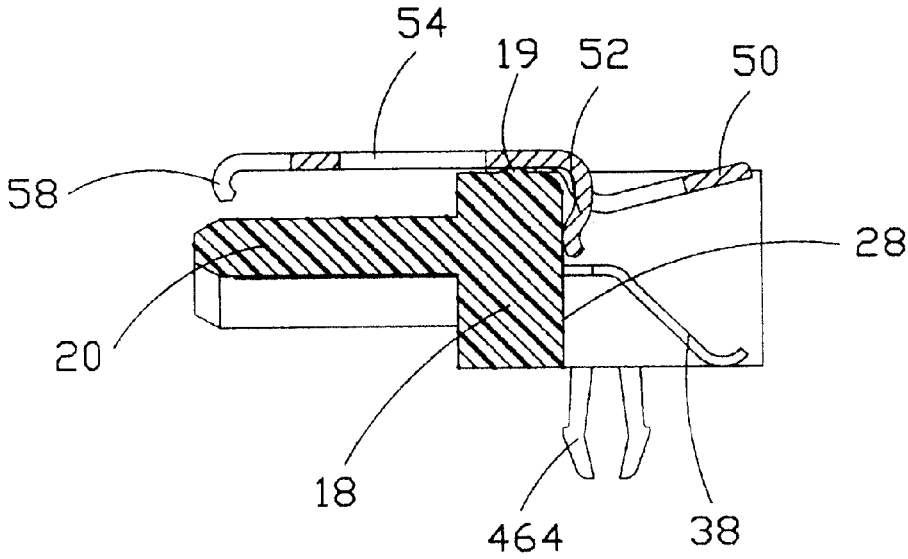
FIG. 7 is a cross-sectional view taken along line 7—7 of FIG. 5.

To assemble the locking member 16 to the insulative housing 12, referring to FIGS. 1–4, the locking member 16 is attached to the housing 12 with the center beam 42 thereof abutting against the rib 19 of the elongate base 18. The lock portions 46 of the locking member 16 are inserted into the lock receiving passages 34 of the mounting portions 32 with the engaging portions 462 engaging with inner side surfaces of the receiving passages 34, as best shown in FIG. 6. The retaining tabs 52, referring to FIG. 7, abut against the rear surface 28 of the base 18. The pair of side arms 54 extends forwardly with the hooks 58 adjacent to the front end of the mating tongue 20.

Figure 8:
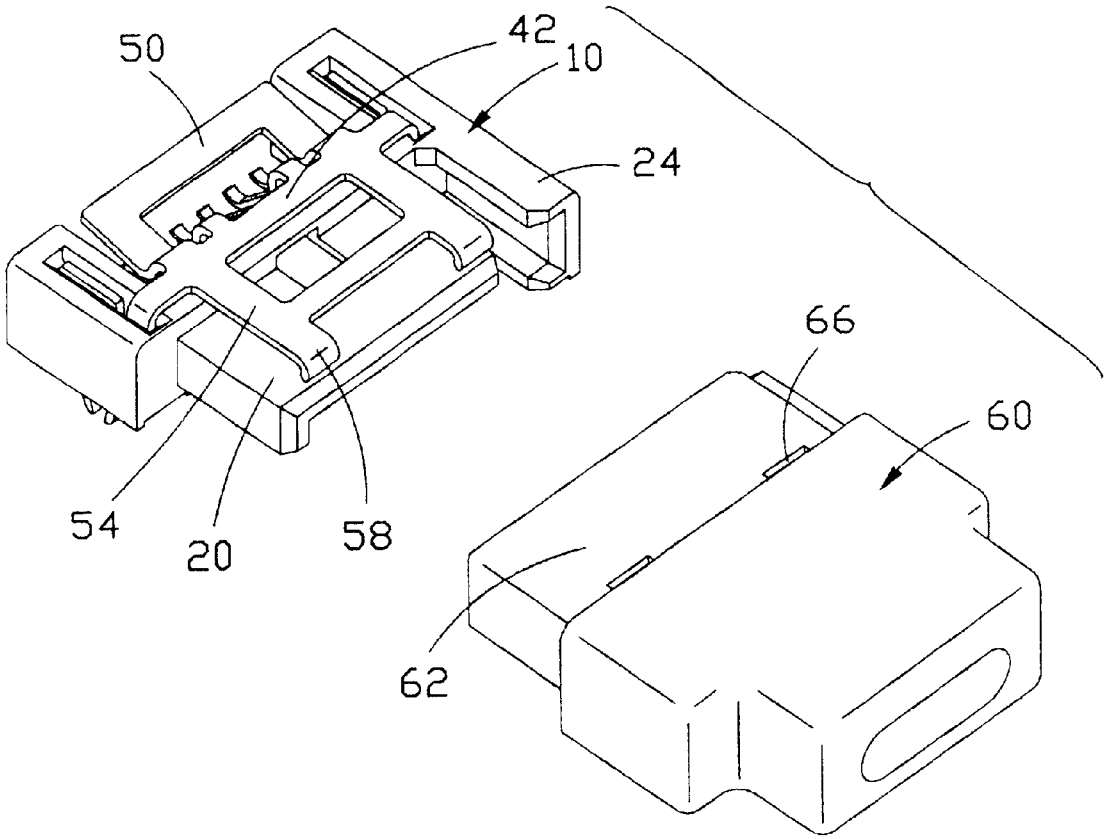
FIG. 8 is a perspective view of the electrical connector of the present invention and a complementary connector for mating with the electrical connector.
Figure 9:
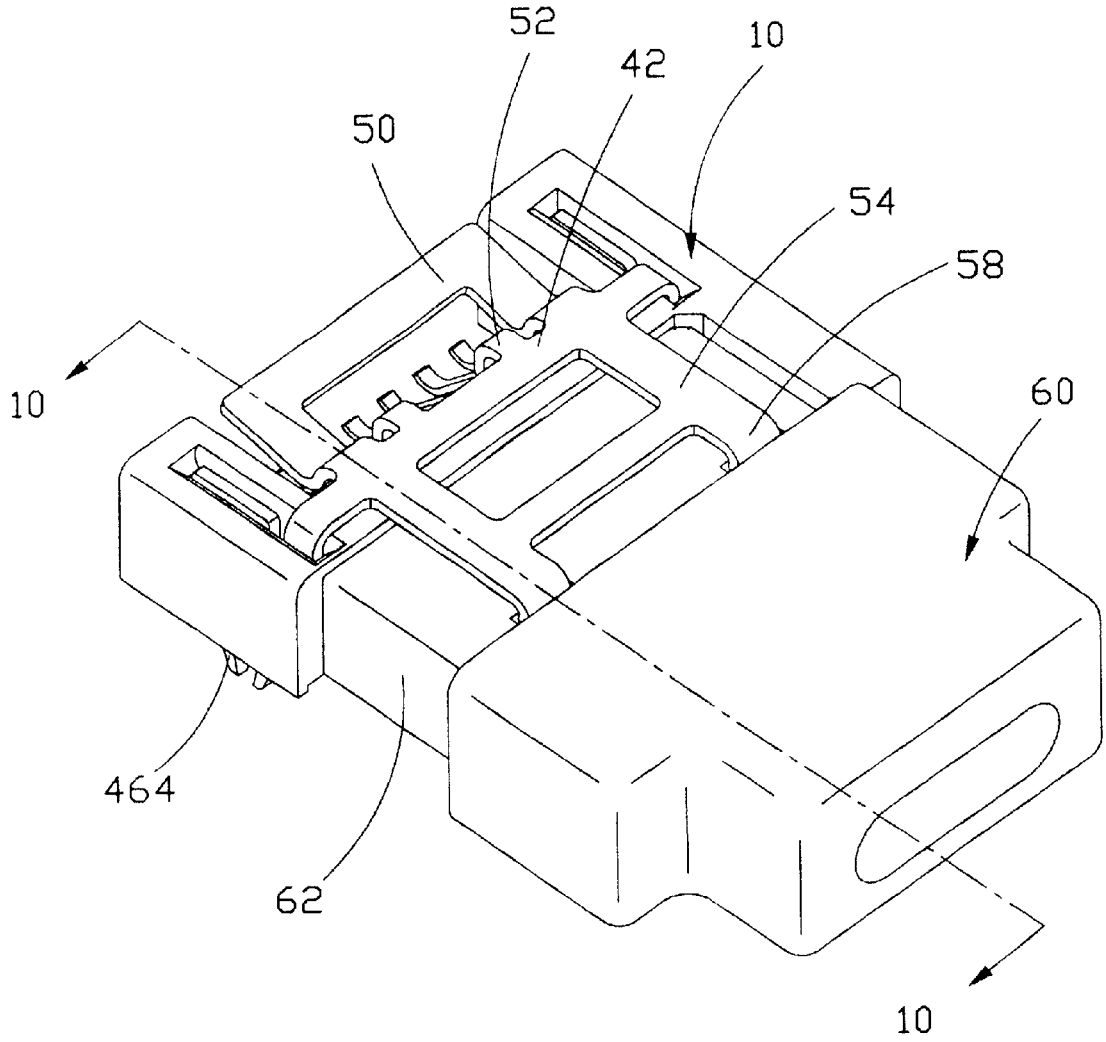
FIG. 9 is an assembled view of FIG. 8.
Figure 10:
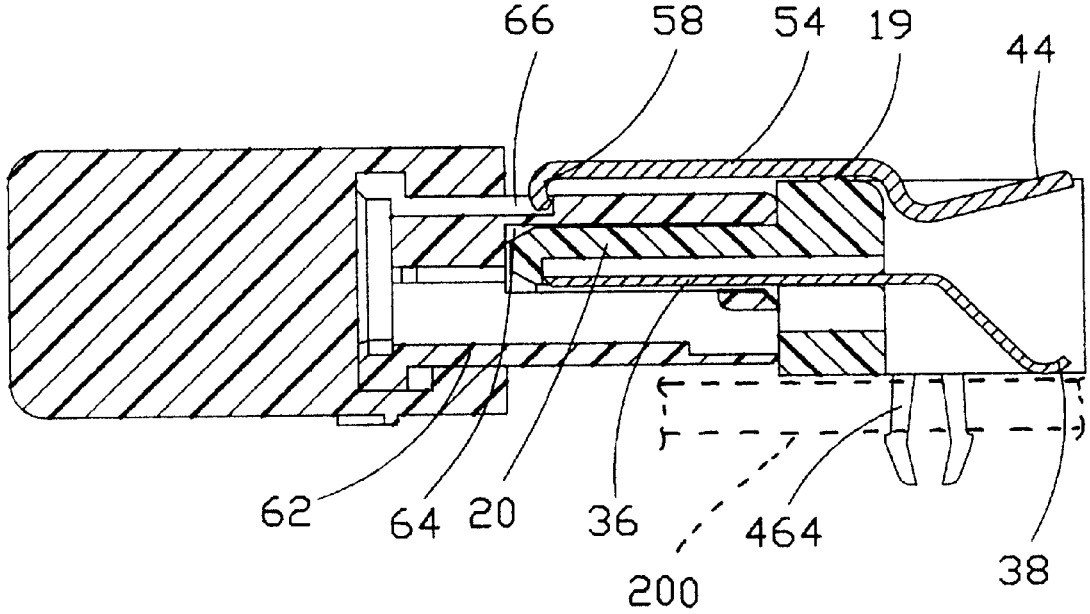
FIG. 10 is a cross-sectional view taken along section line 10—10 of FIG. 9.

In use, the electrical connector 10 is mounted on the printed circuit board with the tail portions 38 of the contacts 14 soldering on the circuit traces thereof, and the legs 464 of the locking member 16 being inserted into appropriate holes in the printed circuit board. The retaining portions 468 of the legs 46 are locked with the printed circuit board and provide a reliable/secure connection between the electrical connector 10 and the printed circuit board. Simultaneously, the electrical connector 10 is provided to mate with the complementary connector 60, as best shown in FIGS. 8–10. The complementary connector 60 has a mating portion 62 which defines the receptacle 64 for receiving the mating tongue 20 of the connector 10. The mating portion 62 defines a pair of receiving holes 66 therein. When the complementary connector 60 mates with the electrical connector 10, the hooks 58 of the locking member 16 can be retained in corresponding receiving holes 66 to provide a reliable mechanical connection therebetween. An electrical transmission therebetween is also provided and would be secure because of the reliable mechanical connection therebetween. It should be noted that, although a pair of side arms 54 each having a hook 58 is disclosed in this preferred embodiment adapted to be retained in a corresponding receiving hole 66 of the complementary connector 60, one center arm with a hook may be used alternatively.

The advantage of the present invention over the prior art is that the locking member 16 of the electrical connector 10 has lock portions 46 for locking the electrical connector 10 to the printed circuit board, and a pair of hooks 58 latching with the complementary connector 60 to secure the mechanical connection therebetween. The mechanical connection between the electrical connector 10 and the printed circuit board or the complementary connector is reliable, and the retention force is thereby enhanced. Furthermore, the manufacturing of the electrical connector 10 with a multi-function locking member 16 stamped and formed from a metal sheet is simplified compared with a conventional electrical connector with a board lock and a latch separately formed for respectively locking with different electrical components.

It should be noted that the locking member 16 has a resilient portion 44, whereby the electrical connector 10 can be easily released from the complementary connector 60. By pushing down the pushing portion 50 of the resilient portion 44, the hooks 58 of the locking member 16 upwardly disengage from the receiving holes 66.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a printed circuit board and mating with a complementary connector, comprising:

a housing defining a pair of lock receiving passages adjacent to opposite ends thereof;

a plurality of contacts mounted in the housing;

a locking member having a center beam abutting against the housing, a pair of lock portions bent downwardly from opposite ends of the center beam and retained in corresponding lock receiving passages, and at least one arm extending forwardly from the center beam, the lock portions adapted to be inserted into appropriate holes of the printed circuit board and the at least one arm having an end portion adapted to be retained in a corresponding receiving hole of the complementary connector for providing a mechanical connection therebetween.

2. The electrical connector as claimed in claim 1, wherein the housing has an elongate base and an L-shaped mating tongue extending forwardly from the base.

3. The electrical connector as claimed in claim 2, wherein the base of the housing defines a plurality of passageways extending therethrough.

4. The electrical connector as claimed in claim 3, wherein the mating tongue of the housing defines a plurality of positioning slits respectively communicating with corresponding passageways of the base.

5. The electrical connector as claimed in claim 4, wherein each contact comprises a contact portion received in a corresponding positioning slit, a tail portion and a retention portion connecting the contact portion and the tail portion, the retention portion being retained in a corresponding passageway.

6. The electrical connector as claimed in claim 2, wherein the base of the housing has a rear surface, and the locking member comprises a plurality of retaining tabs extending rearwardly from the center beam and bent downwardly for engaging with the rear surface.

7. The electrical connector as claimed in claim 2, wherein the housing further comprises a lateral end portion extending parallel to the mating tongue and defining a rectangular recess facing the mating tongue.

8. The electrical connector as claimed in claim 2, wherein the housing comprises a pair of mounting portions extending rearwardly from the base, and each of said lock receiving passages is defined in a corresponding mounting portion.

9. An electrical connector assembly adapted for being mounted on a printed circuit board, comprising:

a first connector comprising a first housing, a plurality of first contacts mounted in the housing and a locking member, the first housing defining a pair of lock receiving passages therein, the locking member comprising a center beam, a pair of lock portions bent downwardly from opposite ends of the beam, and at least one arm extending forwardly from the center beam, the lock portions being retained in and extending out of the lock receiving passages for being inserted into appropriate holes of the printed circuit board, the at least one arm having a curved end portion at a front end thereof; and a second connector comprising a second housing defining at least one receiving hole;

wherein the end portion of the at least one arm of the locking member is retained in a corresponding receiving hole of the second housing when the first connector mates with the second connector.

10. The electrical connector assembly as claimed in claim 9, wherein each lock portion of the first connector comprises a rectangular body and a pair of spaced legs extending from a lower edge of the rectangular body.

11. The electrical connector assembly as claimed in claim 9, wherein the housing of the first connector has an elongate base, the elongate base having a rib projecting upwardly therefrom for engaging with the center beam of the locking member.

* * * * *